United States Patent [19]

Santmyer, Jr.

[11] Patent Number: 4,509,573

[45] Date of Patent: Apr. 9, 1985

[54] CONVERTIBLE LOG SPLITTING DEVICE

[76] Inventor: Kenneth R. Santmyer, Jr., 294 Valley Rd., Furlong, Pa. 18925

[21] Appl. No.: 545,790

[22] Filed: Oct. 27, 1983

[51] Int. Cl.[3] ..... B27L 7/00

[52] U.S. Cl. ..... 144/193 D; 145/1 R; 254/104

[58] Field of Search ..... 254/104; 145/1 R, 2 R; 144/193 R, 193 A, 3 K, 193 C, 193 D, 193 E, 193 K, 366

[56] References Cited

U.S. PATENT DOCUMENTS

| | | | |
|---|---|---|---|
| 1,192,185 | 7/1916 | Gravel | 145/2 R |
| 1,356,413 | 10/1920 | Staub | 145/2 R |
| 2,286,586 | 6/1942 | Starks | 254/104 |
| 3,515,372 | 6/1970 | Courville | 254/104 |
| 3,974,867 | 8/1976 | Butas, Jr. | 144/193 |
| 4,209,046 | 6/1980 | Lavigne | 144/193 |
| 4,387,753 | 6/1983 | Reynolds | 144/193 |
| 4,462,441 | 7/1984 | Hilinger | 144/193 D |

*Primary Examiner*—W. D. Bray

*Attorney, Agent, or Firm*—Howson and Howson

[57] ABSTRACT

A wedge capable of being converted from a conventional mode into a log-quartering mode is disclosed.

1 Claim, 5 Drawing Figures

CONVERTIBLE LOG SPLITTING DEVICE

FIELD OF THE INVENTION

The present invention relates to wood splitting devices, and more particularly, the present invention relates to wedges for use in splitting logs into quarters.

BACKGROUND OF THE INVENTION

Conventional log-splitting wedges have a tapered body with a head at one end and an edge at the opposite end. With such a wedge, a log is usually first split in half, and then each is split into quarters, or in some cases, depending on the diameter of the log, into six or eight pieces. A disadvantage of using the conventional wedge to split logs resides in the time and effort required to restart the wedge each time a split is to be made. Accordingly, a wedge which is capable of splitting a log initially into quarters is highly desirable.

U.S. Pat Nos. 2,286,586; 3,515,372; 3,974,867; 4,209,046; and 4,387,753 disclose various implements useful in splitting logs. While each may function satisfactorily for its intended purpose, there is a demand for a wedge which improves the efficiency and ease with which logs can be split.

OBJECTS OF THE INVENTION

With the foregoing in mind, a primary object of the present invention is to provide a novel wedge which can split a log into quarters, or halves, as desired.

Another object of the present invention is to provide an improved wedge which can be converted quickly from a conventional configuration into a configuration for splitting logs into quarters.

A further object of the present invention is to provide a unique log splitting device which is simple yet rugged in construction and which can split logs efficiently with a minimum of effort.

SUMMARY OF THE INVENTION

More specifically, the present invention provides a convertible splitting wedge which can be used to split logs into either halves, or quarters, as desired. The splitting wedge has a body with a pair of tapered sides from which a pair of quartering members protrude. The quartering members have cutting edges disposed orthogonal to the major cutting edge of the wedge but offset upwardly therefrom. The quartering members are releasably secured to the wedge body by interlocking dovetail surfaces and bolts to enable the wedge to be converted quickly from a conventional configuration into a log-quartering configuration.

BRIEF DESCRIPTION OF THE DRAWINGS

The foregoing and other objects, features and advantages of the present invention should become apparent from the following description when read in conjunction with the accompanying drawings, in which.

DESCRIPTION OF THE PREFERRED EMBODIMENT

Figure 1:
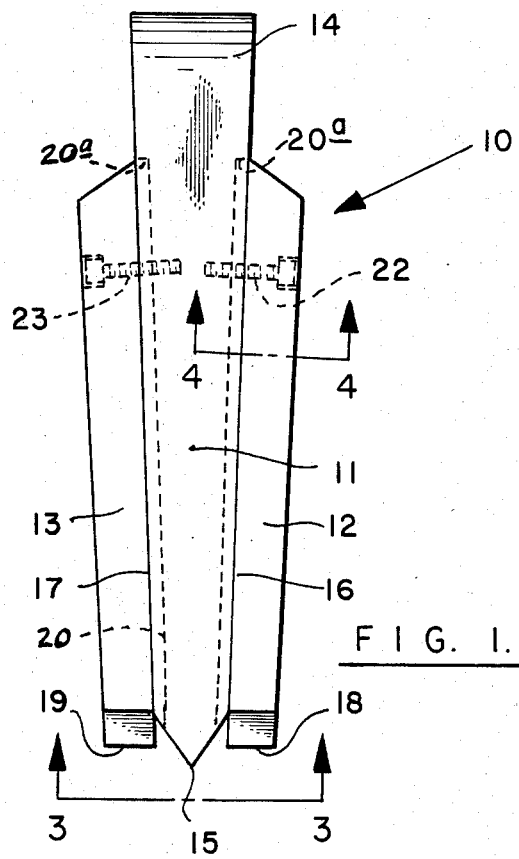
FIG. 1 is an elevational view of a convertible log splitting wedge embodying the present invention.
Figure 2:
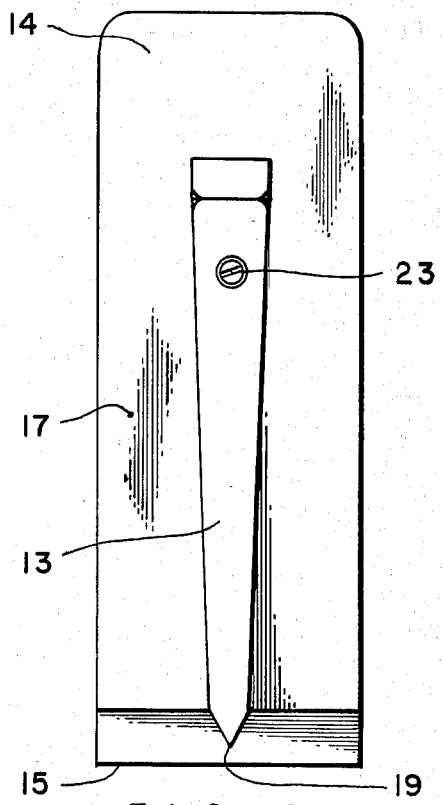
FIG. 2 is a side elevational view thereof.

Referring now to the drawings, FIG. 1 illustrates a splitting wedge 10 embodying the present invention. The wedge 10 comprises a main body 11 and a pair of quartering members 12 and 13 connected to the main body 11. The main body 11 has a driving head 14 at its upper end, and a main edge 15 at its lower end. The main body 11 has a pair of tapered surfaces 16 and 17 extending between the driving head 14 and the edge 15. Preferably, as best seen in FIG. 2, the main body 11 is wider than it is thick.

As described thus far, the main wedge body 11 is conventional. It may be used in the customary manner to split logs by placing the edge 15 against an end of the log and driving the wedge endwise into the log by means of a sledge hammer. Thus the wedge body 11 can be used to split relatively large diameter logs, i.e. logs with a diameter greater than about 12 inches.

As noted heretofore, one of the disadvantages of using a conventional wedge to split logs is the need to restart the wedge for each split and the time required to do this. While there are certain size logs which will be amenable to being split only with a conventional wedge, there is a range of log sizes which can be split into quarters using the splitting wedge of the present invention. By way of example, and not by way of limitation, the wedge of the present invention should be capable of splitting directly into quarters, logs up to about 18 inches in diameter. By splitting a log directly into quarters, a considerable amount of time and effort can be saved over what would normally be required if a conventional wedge were used to split logs of the same size.

Figure 3:
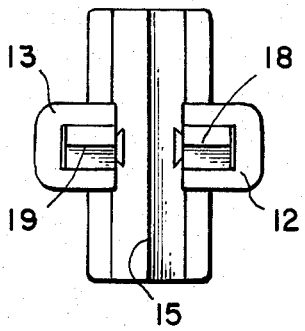
FIG. 3 is a bottom plan view thereof taken on line 3—3 of FIG. 1.

To this end, the quartering members 12 and 13 extend substantially the entire length of the wedge body 11 and are disposed centrally thereof in the tapered sides 16 and 17, of the main body 11 respectively. The lower ends of the quartering members 12 and 13 are provided with auxiliary splitting edges 18 and 19, respectively, which as best seen in FIG. 3, are disposed orthogonal to the main splitting edge 15. As seen in FIG. 1, the auxiliary edges 18 and 19 are recessed upwardly from the main splitting edge 15. As a result, the main splitting edge 15 penetrates the log ahead of the auxiliary edges 18 and 19 to facilitate starting of the wedge 10.

Figure 4:
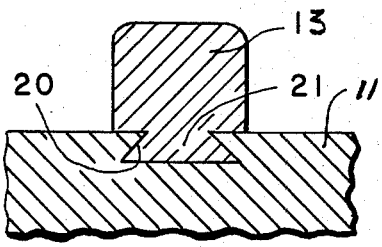
FIG. 4 is an enlarged fragmentary sectional view taken on line 4—4 of FIG. 1.

The quartering members 12 and 13 are releasably connected to the main wedge body 11 to enable the wedge body 11 to be used in either the conventional mode or in the quartering mode. For this purpose, interengaging surface means are provided on the wedge body 11 and the quartering members 12 and 13. In the present invention, the surface means includes a female dovetail groove 20 in each side of the wedge body 11, such as the side 17, and a mating male rib 21 on each quartering member, such as the member 13. See FIG. 4. The groove 20 extends substantially the entire length of the main wedge body 11, beginning adjacent the main splitting edge 15 and terminating at an abutment surface 20*a* adjacent to the driving head 14. The abutment surface 20*a* engages the upper end of the male rib 21 to transfer splitting forces from the auxiliary edge to the main wedge body 11.

The quartering members are engaged with the main wedge body simply by sliding them lengthwise after the mating dovetail surfaces have been engaged adjacent the main edge 15. They are disengaged by reversing this procedure. To keep the quartering members engaged with the main wedge body 11, threaded fasteners, such as bolts or machine screws 22 and 23 pass through the quartering members 12 and 13, respectively and are received in threaded bores in the main wedge body 11. Preferably, the quartering members are countersunk so that the heads of the bolts 22 and 23 do not protrude beyond the sides of the quartering members.

Figure 5:
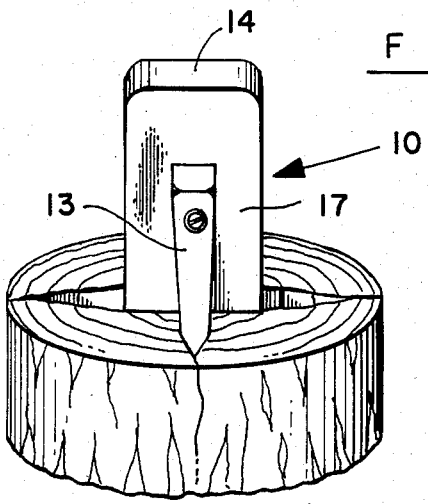
FIG. 5 is a perspective view illustrating the wedge of the present invention partially engaged in a log.

In use, the main edge 15 of the wedge 10 is placed against the upper end of a log, such as the log illustrated in FIG. 5. The upper end 14 of the wedge 10 is struck with a sledge hammer to cause the edge 15 to penetrate the log slightly. After the edge 15 has penetrated the log, the auxiliary edges 18 and 19 of the quartering members 12 and 13 engage and penetrate the log. Continued hammering on the driving head causes the wedge 10 to penetrate deeply into the log, such as illustrated in FIG. 5, and this causes the log to split into quarters, in the manner illustrated. In the event log quartering is not desired, the quartering members 12 and 13 can be removed quickly from the main wedge body 11 simply by loosening the bolts 22 and 23 and sliding the quartering members 12 and 13 downwardly.

In view of the foregoing, it should be apparent that the present invention now provides an improved convertible log-splitting wedge which can be used in either a conventional mode or in a log quartering mode. The conversion between these two modes can be made quickly and easily.

While a preferred embodiment of the invention has been described in detail, various modifications, alterations and changes may be made without departing from the spirit and scope of the present invention as defined in the appended claims.

I claim:

1. A splitting wedge for use in splitting a log, comprising:

an elongated wedge body having tapered sides extending between a driving head at one end and a major edge at the opposite end, a pair of quartering members extending lengthwise of said wedge body along opposite sides thereof and having auxiliary edges extending orthogonal to said major edge a spaced distance upwardly therefrom, interengaging surfaces extending lengthwise in said wedge body and on each quartering member for slidably mounting said quartering members to said wedge body, said surfaces defining a dovetail groove extending in each tapered side of said wedge body and a shaped tongue on each quartering member, abutment surface means in said groove on the wedge body and on said tongue of each quartering member adjacent its upper end for engaging one another to transfer pressure from the wedge body to each quartering member, and fastener means releasably coupling said quartering members to said wedge body, whereby the cutting wedge may be used to split logs into various shapes.

* * * * *